United States Patent [19]

Weingarten

[11] 4,177,804

[45] Dec. 11, 1979

[54] AUTOMATIC MASSAGING DEVICE

[76] Inventor: Fred Weingarten, 507 Country Club Dr., Cherry Hill, N.J. 08003

[21] Appl. No.: 923,977

[22] Filed: Jul. 12, 1978

Related U.S. Application Data

[63] Continuation of Ser. No. 772,771, Feb. 28, 1977, abandoned.

[51] Int. Cl.[2] ..... A61H 7/00

[52] U.S. Cl. ..... 128/52; 128/57

[58] Field of Search ..... 128/51, 52, 56–58, 128/24.3; 46/212

[56] References Cited

U.S. PATENT DOCUMENTS

| | | | |
|---|---|---|---|
| 2,091,004 | 8/1937 | Marx | 46/212 |
| 2,624,335 | 1/1953 | Miller | 128/57 X |
| 3,067,738 | 12/1962 | Karlik | 128/57 |
| 3,297,024 | 1/1967 | Robinson | 128/57 X |
| 3,996,929 | 12/1976 | Mabuchi | 128/58 |
| 4,041,938 | 8/1977 | Wintoniw | 128/52 |

*Primary Examiner*—Lawrence W. Trapp

*Attorney, Agent, or Firm*—Michael B. Fein

[57] ABSTRACT

An automatic massaging device comprising at least one massaging element having resilient prong-like extensions, driven by a motor, with automatic switching means to reverse the direction of rotation of the device.

13 Claims, 8 Drawing Figures

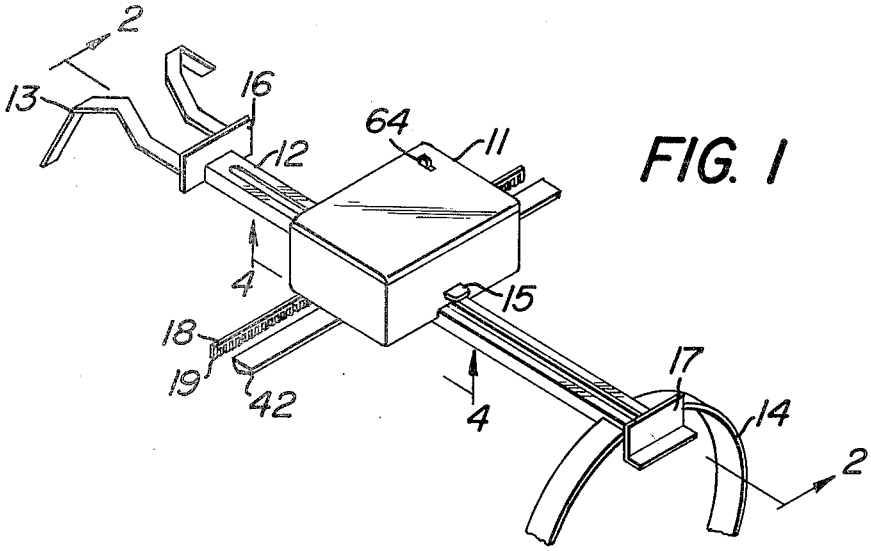
FIG. 1
FIG. 2
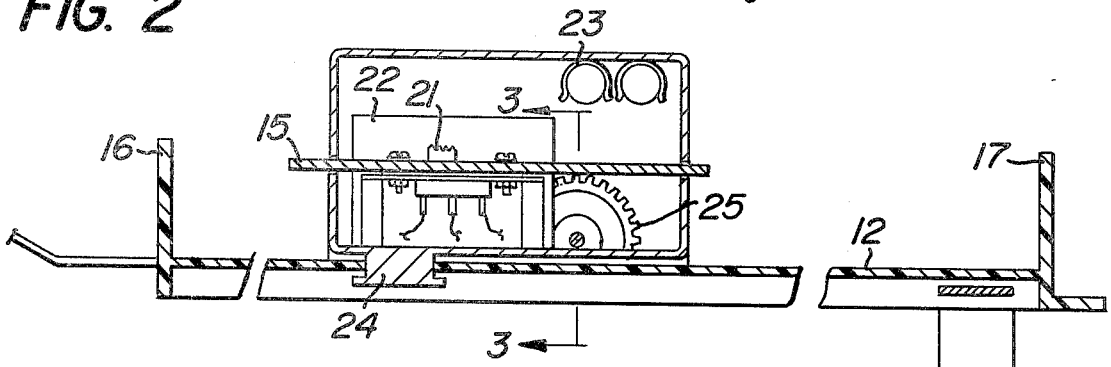
FIG. 3
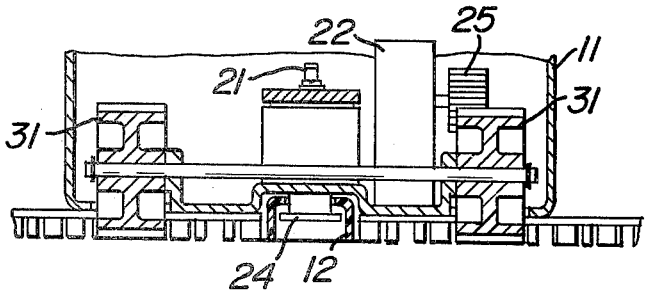
FIG. 4
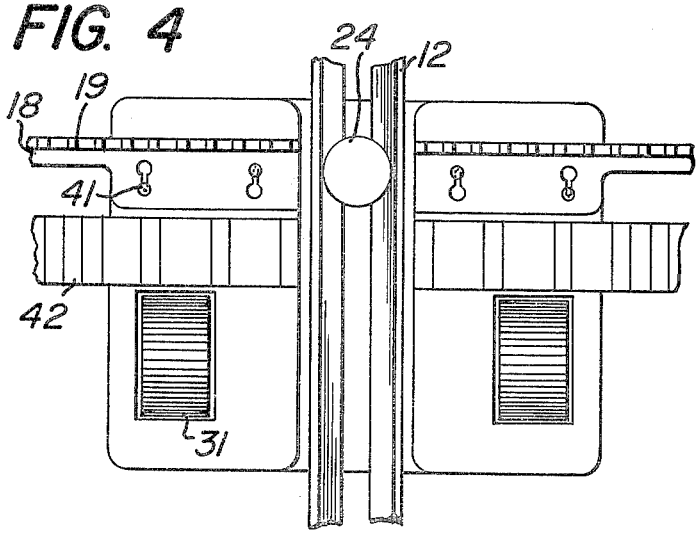
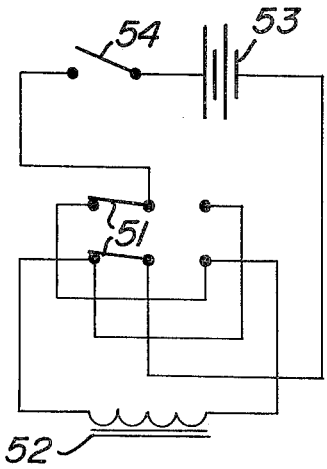
FIG. 5

FIG. 6
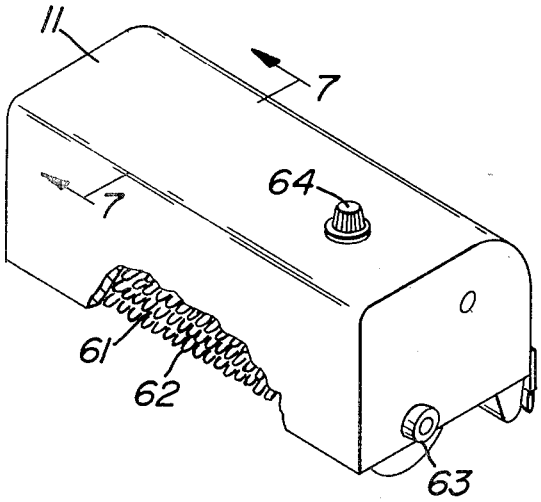
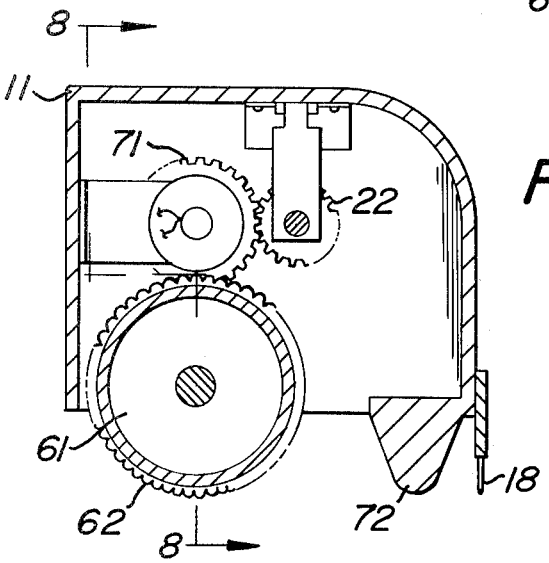
FIG. 7
FIG. 8
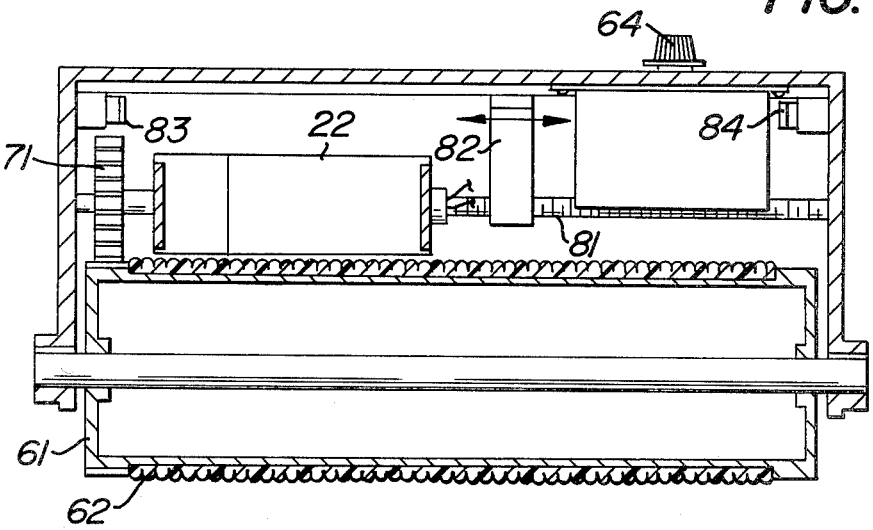

AUTOMATIC MASSAGING DEVICE

This is a continuation of abandoned application Ser. No. 772,771 filed Feb. 28, 1977.

BACKGROUND OF THE INVENTION

1. Field of the Invention

This invention relates to an automatic back massaging device.

2. Description of the Prior Art

Prior automatic massage devices were unweildy, required permanent floor space so as to make them unsuitable for home use, and had ineffective massaging action. See, for example, Gerlich U.S. Pat. No. 3,799,155 which shows a plurality of spherical elements (balls) on strings from a common support structure which is laterally reciprocal by means of a large, permanently mounted reciprocal motor device.

Other prior massaging devices required an operator, making them unsuitable for use by the massagee alone. See, for example, Wagner U.S. Pat. No. 2,628,611.

SUMMARY OF THE INVENTION

It is an object of the present invention to provide an automatic massaging device which is effective and can be operated by the person being massaged without help from others. A further object is to provide a device which is not excessively large and is suitable for home use. A still further object is to provide a device which is effective and yet can be conveniently stored without having to be disassembled.

These, and other objects as will become apparent from the following detailed description, are achieved by the present invention which comprises an automatic back massaging device adapted to travel up and down the back of the user, at least one massaging element mounted on said housing, a motor mounted in said housing adapted to drive said device, and automatic switching adapted to reverse the direction of rotation of said device.

BRIEF DESCRIPTION OF THE DRAWINGS

FIG. 1 is a perspective of one embodiment of the device of the invention;

FIG. 2 is a side elevational view, partially in section, of the device with the massaging elements removed;

FIG. 3 is a rear elevational view in section through 3—3 of FIG. 2;

FIG. 4 is a bottom elevational view of the device of the invention;

FIG. 5 is a schematic of the electrical system of the invention;

FIG. 6 is a perspective of the second embodiment of the invention;

FIG. 7 is a side elevational view in section through 7—7 of FIG. 6;

FIG. 8 is a rear elevational view of the second embodiment partially in section through 8—8 of FIG. 7.

DETAILED DESCRIPTION OF THE INVENTION AND THE PREFERRED EMBODIMENTS

Referring to FIG. 1 which shows a preferred embodiment of the invention, the housing 11 is illustrated slidably engaged with slotted track structure 12 which has shoulder engagement extentions 13 and hip engagement extensions 14.

Moveable actuator 15 is adapted to engage switch 21 (FIG. 2) and to strike end plates 16 and 17 at the end of travel along the slotted track 12. The reversing switch 21 is connected electrically as shown in FIG. 5 at 51 so as to reverse the direction of motor 22 (FIG. 2) shown at 52 in FIG. 5.

Batteries 23 (53 in FIG. 5) drive motor 22, but any source of electrical energy is suitable.

Referring to FIG. 2, slidable engagement means 24 guides the moveable device in a direction parallel to the user's backbone, and the gear drive 25 engages the massaging rollers which also drive the device. Preferably the track is designed to conform to a person's back in curvature. The massaging elements 18 and 42 are also preferably curved to conform to the curvature of the back. In another embodiment illustrated in FIGS. 3, 6, 7, and 8, the gear drive 25 engages massaging rollers 31 which engage the back of the user for a combined massaging effect and drive means.

Massaging element 18 has resilient prong-like extensions 19 which are optional but preferred, and is mounted on the housing as shown by slot and prong means 41 or any other means, or can be part of the housing strusture itself. Secondary massaging element 42 can either be a roller, preferably having grooves or prongs, or can alternatively be a non-rolling, elongated structure made from a resilient material which massages the back as it travels back and forth.

In the alternate embodiment shown in FIG. 6, the housing 11 carries a roller 61 having resilient prong-like extensions 62 rotatably mounted 63 in housing 11 and driven by gear drive means 71 which is driven by motor 22. A rake 18, also having resilient prong-like extensions, guides the device along the user's back, in combination with guide means 72 (FIG. 7). No slotted track in harness is needed in this alternative embodiment. Reversing action in the alternative embodiment is by means of a striking means 82 travelling back and forth by means of screw drive means 81 and striking reversing switches 83 and 84 at the respective ends of travel.

The device has an on-off switch 64 mounted in the housing (54 in FIG. 5) which also preferably acts as a speed adjustment switch to control the motor speed, and hence the speed at which the device travels up and down the user's back for massaging effect.

The device can be employed by the user laying on his stomach, or the device may be incorporated into the back of a specially adapted chair so the user can be massaged while sitting in the chair.

Having described two embodiments of my invention in great detail, various modifications, alternatives, and improvements should become apparent to those skilled in the art without departing from the spirit and scope of the invention as described in the following claims.

I claim:

1. An automatic back massaging device, adapted to travel up and down the back of the user, comprising at least one massaging element which engages the back of the user for a combined massaging effect and drive means, means for shoulder and hip engagement, with track structure in between, a housing slidably mounted on said track, said massaging element mounted in said housing, a reversable motor mounted in said housing to drive said device, and automatic switching means adapted to reverse the direction of said device.

2. The device of claim 1 further including a resilient, comb-like rake fixedly mounted on said housing and adapted to guide the direction of said device and to add to the massaging effect.

3. The device of claim 1 wherein said housing further includes means for slidable engagement to the slotted track.

4. The device of claim 3 further including a slotted track structure in a harness adapted to engage a person so that the slotted track is adjacent to the backbone of a person, and the slidable engagement means of the housing is engaged to the slotted track.

5. The device of claim 4 further including a gear drive means adapted to engage massaging wheels.

6. The device of claim 1 wherein the motor is adapted to drive the housing by means of a rotatably mounted roller having resilient prong-like extentions.

7. The device of claim 1 further including a battery adapted to drive said motor.

8. The device of claim 1 further including motor speed adjusting means.

9. The device of claim 1 wherein the massaging element has resilient, prong-like extensions.

10. An automatic back massaging device adapted to travel back and forth on the back of the user, comprising at least one massaging element which engages the back of the user for a combined massaging effect and drive means, a housing, said massaging element mounted in said housing, a reversable motor mounted in said housing adapted to drive said device, automatic switching means completely within the housing adapted to reverse the direction of said device after a predetermined distance of travel, said device being self-contained, unmounted, self propelled, and free of any harness.

11. An automatic back massaging device in accordance with claim 10 wherein said massaging element is the sole drive means, and said device is driven solely by said massaging element, said massaging element being rotated by said reversible motor.

12. An automatic back massaging device adapted to travel back and forth on the back of the user comprising at least one massaging element adapted to engage the back of the user and both drive the device and cause massaging effect on the back of the user, having reversing means completely within the housing for reversing the direction of travel after a predetermined distance, said device being self-contained, self-propelled, unmounted, and free of any harness.

13. An automatic back massaging device in accordance with claims 10, 11, or 12 wherein said massaging element has resilient, prong-like extensions.

* * * * *